US005636649A

United States Patent [19]

Horvath

[11] Patent Number: 5,636,649

[45] Date of Patent: Jun. 10, 1997

[54] SHIELDING DEVICE FOR PROTECTING RECREATION AREAS

[75] Inventor: John Horvath, 14016 Chestnut La., Orland Park, Ill. 60462

[73] Assignee: John Horvath, Orland Park, Ill.

[21] Appl. No.: 551,531

[22] Filed: Nov. 1, 1995

[51] Int. Cl.[6] ..... B60R 11/00; A45B 11/00; E04H 4/00

[52] U.S. Cl. ..... 135/16; 135/90; 135/96; 135/98; 135/15.1; 135/20.1; 4/496; 248/910

[58] Field of Search ..... 4/496, 494, 498, 4/503; 248/910, 214; 135/90, 96, 98, 15.1, 16, 20.1

[56] References Cited

U.S. PATENT DOCUMENTS

| | | | |
|---|---|---|---|
| 332,917 | 12/1885 | Markham . | |
| 560,245 | 5/1896 | Wagner . | |
| 1,053,337 | 2/1913 | Williams . | |
| 1,268,767 | 6/1918 | Peak . | |
| 2,634,740 | 4/1953 | Duke . | |
| 3,407,825 | 10/1968 | Doyle . | |
| 3,486,514 | 12/1969 | Prescott . | |
| 4,086,931 | 5/1978 | Hall . | |
| 4,334,692 | 6/1982 | Lynch . | |
| 4,759,545 | 7/1988 | Grable . | |
| 4,832,163 | 5/1989 | Levesque | 135/16 X |
| 4,903,926 | 2/1990 | McNarry et al. | 135/95 |
| 4,927,117 | 5/1990 | Gainey . | |
| 5,002,081 | 3/1991 | Stromeyer | 135/90 X |
| 5,112,023 | 5/1992 | Sowers | 248/519 |
| 5,205,308 | 4/1993 | Kendall et al. | 135/90 |
| 5,242,029 | 9/1993 | Marcella | 182/82 |
| 5,333,322 | 8/1994 | Weir | 4/496 |
| 5,390,685 | 2/1995 | McCoy | 135/19 |
| 5,431,364 | 7/1995 | Etter | 135/16 X |
| 5,452,877 | 9/1995 | Riffle et al. | 135/16 X |
| 5,499,644 | 3/1996 | Geniele | 135/20.1 |

OTHER PUBLICATIONS

Preferred Living Catalog, pp. 58–59, 1995–1996 Ed.

*Primary Examiner*—Wynn E. Wood

[57] ABSTRACT

A cantilevered canopy has four elements including an umbrella, a pole, a mounting bar and an anchoring means and can be mounted on the side of a swimming pool, or adjacent an area of utilization so as to afford shading protection to the user at a location remote from the point of support.

7 Claims, 2 Drawing Sheets

SHIELDING DEVICE FOR PROTECTING RECREATION AREAS

BACKGROUND OF THE INVENTION

1. Field of the Invention

This invention relates to a structural system for protecting recreational areas, such as a swimming pool, or a patio, or a children's sandbox. More particularly, this invention relates to a support structure for selectively suspending an umbrella or parasol over a designated area which is relatively remote from the actual point of support.

2. Description of the Prior Art

The art is represented by patio canopies and beach umbrellas which customarily provide a support column extending to the base of support at the center of the canopy or umbrella. There are available patio canopy constructions which embody the so-called European styling found in open-air cafes throughout Europe wherein a permanent base is located at a location offset from the point of utilization. In such European structures the canopy is cantilevered in the manner of a basket hoop on a backboard of a basket ball goal.

Somewhat similar cantilever support structures are also provided for water polo goals located at the ends of a swimming pool in which the game is played.

SUMMARY OF THE PRESENT INVENTION

The present invention contemplates the construction of a cantilevered holder for an umbrella or canopy which is portable and transportable and can be utilized effectively by women and children and senior citizens to provide a shaded area, for example, in an in-ground swimming pool, where the user does not want to leave the pool, but has had a sufficient exposure to the sun.

The conventional umbrella for recreational shading is approximately five feet above ground level and is capable of providing shade for two lounge chairs. By the present invention, there is provided an umbrella holder which consists of the usual vertical pole holder that is part of the umbrella unit. However, there is additionally provided a laterally extending mounting bar projecting at ground level to an area remote from the point of utilization. At an intermediate portion of the mounting bar, and in order to prevent angular rotation of the mounting bar, one or more stabilizing arms may be provided. At the free end of the mounting bar, a securing means or anchoring means may be provided. In one form of the invention, the anchoring means may constitute a hook which conveniently engages the edge of the pool apron, for example, a pool apron made of concrete and surrounding the pool to form a pool deck area. In another form of the invention, the anchoring means constitutes a stand, which may carry a ground engaging wheel means so that it may be easily and readily moved around to a selected location by someone of limited physical prowess. In order to give the stand added anchoring ability, it may further include a filling and drainage opening so that it may be weighted with a supply of water.

It is further contemplated by the present invention that the entire combination assemblage, i.e., the canopy, or umbrella, the pole, the mounting bar and the anchoring stand can be folded together in a compact form and handled by the user as a kit that is conveniently stored when not in active use.

DESCRIPTION OF THE PREFERRED EMBODIMENTS

Figure 1:
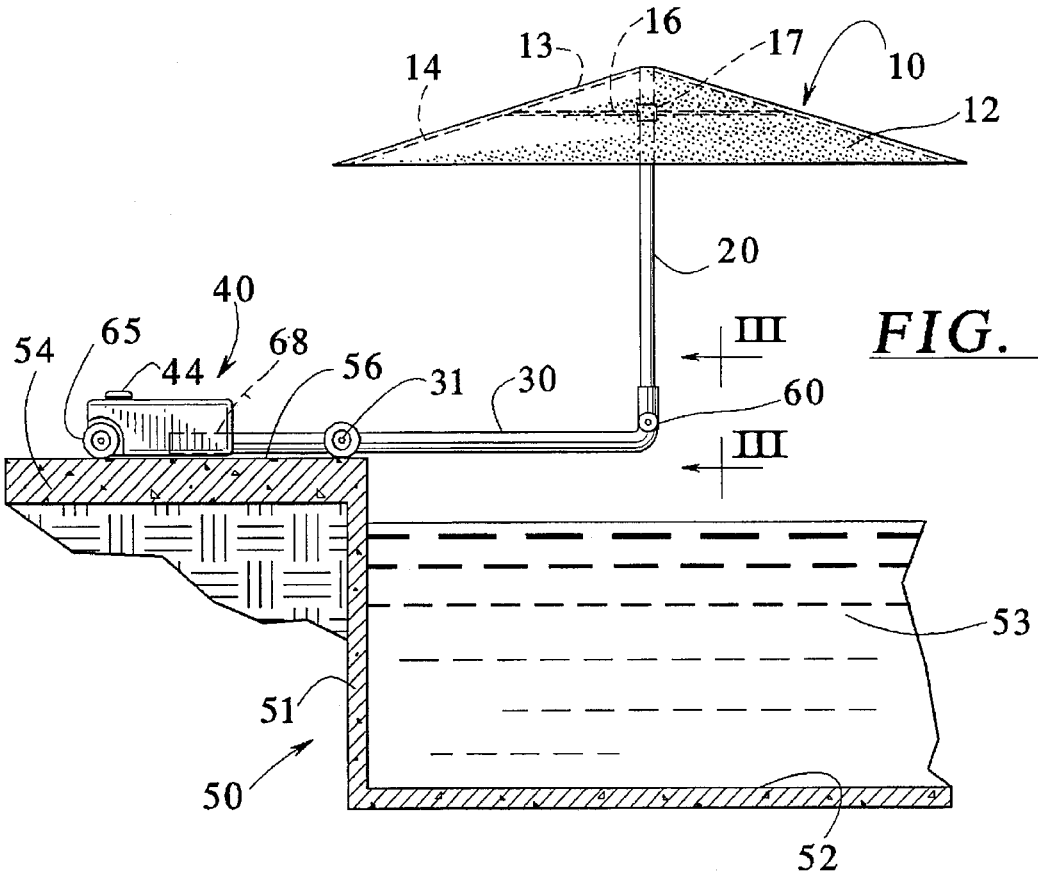
FIG. 1 is a side elevational view of one exemplar form of the present invention and showing an in-ground pool in fragmentary cross-section to illustrate how the shading device is employed in accordance with the principles of the present invention.

The present invention has utility in any environment where it is desirable to shield a selected area which is remote from an accessible location so that it would be desirable to provide a cantilevered support which is compatible with existing umbrellas and which can be handled safely and effectively by women and children and senior citizens.

The structure of the present invention consists essentially of only four separate main parts: (1) a canopy, or umbrella which will be identified at 10; (2) an umbrella pole which will be identified at 20; (3) a mounting bar which will be identified at 30; and (4) an anchoring means which will be identified at 40.

Referring to the drawings, it will be noted that the canopy or umbrella is shown at 10 and constitutes a retractable umbrella of the usual type provided for use on patios or on open-air esplanades and cafes. One of the advantages of the present invention is that it can be effectively utilized to retrofit most commercially available umbrellas for use in the special use environments contemplated.

The umbrella 10 may comprise a cover 12, which in the illustrative embodiment of this disclosure is generally square. However, it could be round, or circular. Further, it can be made of any desirable material suited to the purpose of shielding against the sun and/or rain. In some instances, the cover 12 may comprise a heavy opaque material which completely blocks the sun's rays, while in other instances, the cover 12 may constitute a relatively diaphanous material which is lacy in character and/or it may be relatively transparent, or translucent, such as a sheet-form plastic film.

In any event, the cover 12 is a fabric or a sheet-form material which is held on a collapsible frame 13 of a first set of thin ribs 14 radiating from the top of the umbrella pole 20. A second set of thin ribs 16 is connected at one end to a sliding ring 17 carried by the pole 11 and connected at the other end to an intermediate portion of a corresponding one of the first set of ribs 14.

In order to support the umbrella 10 in an upright position, there is provided the second part, namely, the umbrella support pole 20 which provides an upright vertical support column to which the umbrella 10 is adjustably connected. The pole 20 of the present invention is shown as comprising a hollow tubular cylinder made of metal and sized to cooperate with the ring 17. In most constructions, there will be provided a latch and detent means so that the ring 17 can be selectively positioned and locked at an uppermost position on the pole 20 when the umbrella is open or at a lowermost position on the pole 20 when the umbrella is closed.

In a conventional prior art usage, the umbrella pole 20 is inserted into a heavy base member which is usually counterweighted with sand or cement and which in many instances may be positioned underneath the midpoint of a table. The user can access the ring 17 and can raise or lower the umbrella at will.

In accordance with the principles of the present invention, however, it is contemplated that the umbrella or canopy 10 can be positioned over an inaccessible location, thereby to give protection and comfort to a user under circumstances where normal access would be difficult, if not impossible. For example, many persons of advanced years find that usage of a swimming pool offers the opportunity for excellent physical therapy as well as for comfort and enjoyment and relaxation. Such persons would like to avail themselves of these special benefits without undue exposure to the rays of the sun.

Figure 2:
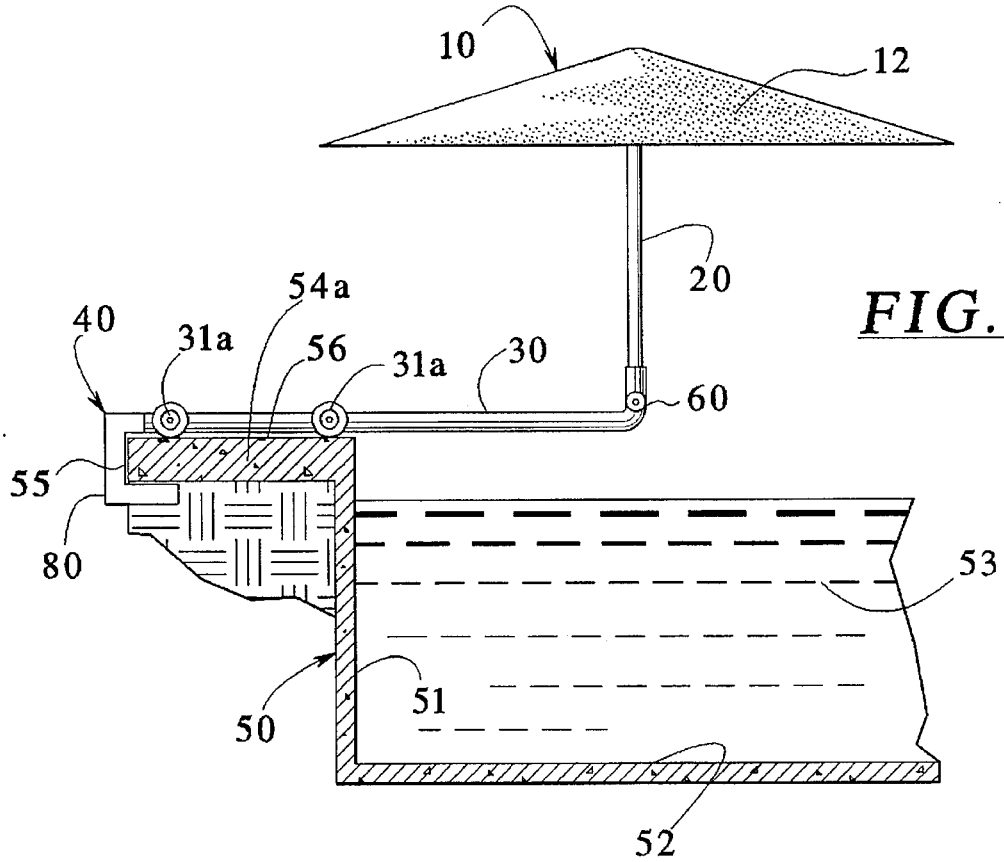
FIG. 2 is a side elevational view of a second form of the present invention generally similar in overall layout to the form of the invention shown in FIG. 1.
Figure 4:
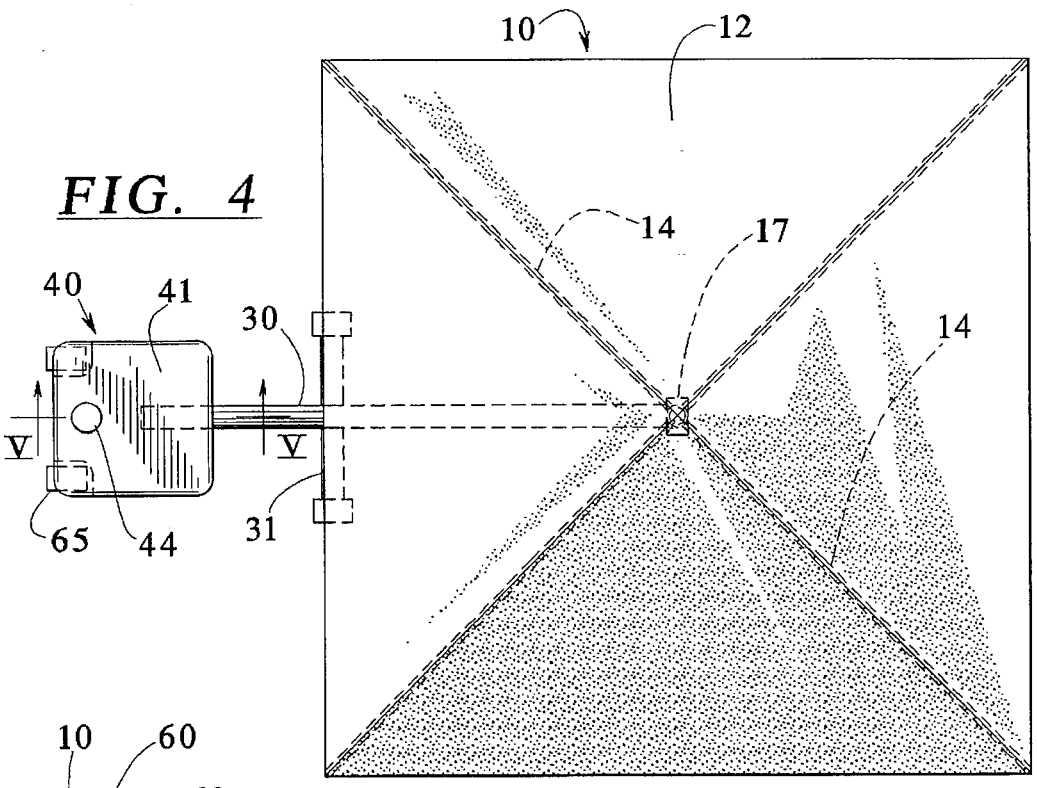
FIG. 4 is a plan elevational view of the invention illustrated in FIG. 1, but with parts of the pool removed for the sake of clarity.

Thus there is shown in FIGS. 1 and 2 an in-ground swimming pool 50 having the usual side walls 51 extending below grade level and a bottom wall 52 so that the pool can be filled with a supply of water shown at 53. The ground surface in which the pool 50 is sunken is surmounted by an apron at ground level extending around the edge of the pool as shown at 54. In FIG. 1, the apron 54 comprises a concrete slab forming an extended pool deck 56 on which may be placed such pool side accessories such as deck chairs and possibly tables and/or lounge chairs.

The usual umbrella 10 is about five feet high if it is to protect two lounge chairs from the rays of the sun. Accordingly, to protect a remote area in the interior of the pool 50, i.e., an area which is inaccessible from the pool-side deck surface 56, the present invention contemplates the provision of a mounting bar 30.

Figure 3:
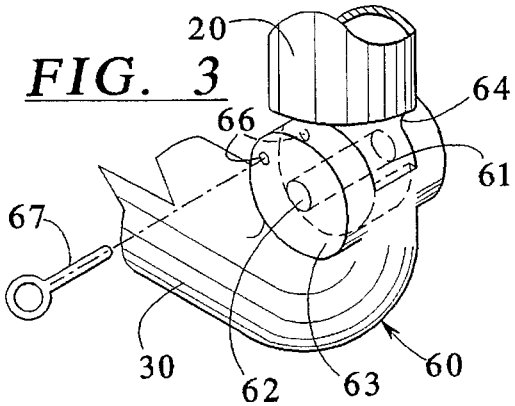
FIG. 3 is a fragmentary enlarged view taken in the direction of line III—III of FIG. 1 and shows additional details of a swivel joint provided for the purposes of the present invention.

The mounting bar 30 constitutes an elongated relatively thin member which is designed to extend at deck level, i.e., at the level of the deck 56, and to project from the deck 56 out over the water 53 in the pool 50. Such criterion is met by a metal cylindrical tube having at one end thereof a coupling joint 60, the structural details of which are illustrated in FIG. 3. The coupling joint 60 is a so-called swivel joint and in this disclosure the swivel joint has a ball and knuckle fitting which comprises a ball 61 which is rotatably journalled on a shaft 62 carried in a knuckle 63, formed on, or connected to, the outermost end of the mounting bar 30. The ball 61 has a male part 64 sized and shaped to be telescopically mated with the end of the umbrella pole 20. Thus, by rotatably positioning the ball 61 so that the umbrella pole 20 is at right angles to the mounting bar 30, the umbrella 10 will be positioned in upright position superjacent the pool 50 above the water 53. Thus, the mounting bar 30 extends away laterally from the reference axis or the pole 20 and the umbrella 10.

In order to lock the ball and knuckle joint in the selected position, each of the parts may be provided with appropriate mated openings 66 for receiving a cotter pin 67. In order to safeguard the mounting bar against inadvertent angular rotation which might tip the umbrella 10 into the water 53, the mounting bar 30 is provided with one or more stabilizing bars or arms 31 which may be connected to the bar 30 and which project laterally therefrom in engagement with the deck 56

At the opposite end of the mounting bar 30, there is provided the fourth element of the combination, namely, the anchoring means 40. In the form of the invention illustrated in FIG. 1, the anchoring means 40 takes the form of a stand 41 comprising a generally rectangular shaped box which is hollow on the inside to form a compartment 42. The compartment has a filling and drainage nozzle 43 in the top wall closed by a removable cap 44 so that a supply of ballast water may be charged into the compartment 42, thereby increasing the weight of the anchoring means 40 by about 50 to 70 pounds.

One or more wheels (two, in the exemplary embodiment of this disclosure) are mounted rotatably in one end of the stand 41 as shown at 65. The side walls of the stand 41 are appropriately recessed at 67 to accommodate the wheels. At the opposite end of the stand 41, a recess 68 is provided into which the end of ;the mounting bar 30 is inserted. The stand 41 and the mounting bar are locked in firm assembly with one another by appropriate locking means such as the pins 69.

Figure 6:
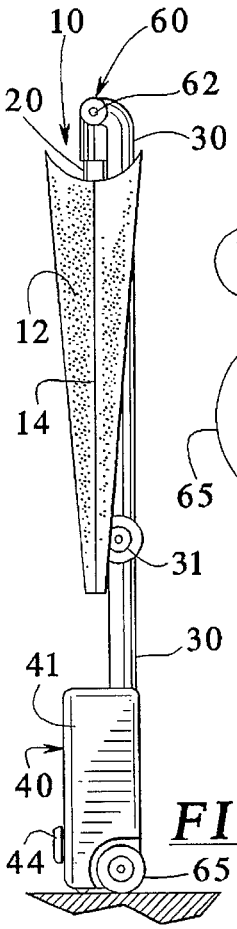
FIG. 6 is a side elevational view of the structure of FIG. 1, but folded to a storage position as provided by the present invention.
Figure 5:
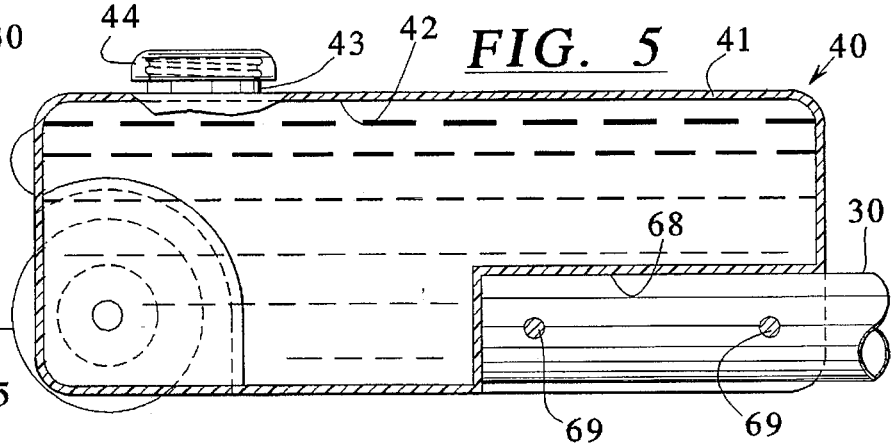
FIG. 5 is a fragmentary cross-sectional view taken on line V—V of FIG. 4.

The entire assembly folds up into an extremely manageable kit as shown in FIG. 6. The umbrella 10 has its cover retracted, the umbrella pole 20 is rotatably folded back upon the mounting bar 30, and the entire assembly is rotatably supported on the wheels 65 forming a part of the stand 41. The pole 20 prescribes a vertical reference axis which is coincident with the central axis of the umbrella 10.

In the form of the invention illustrated in FIG. 2, the pool 50 has an apron 54(*a*) which terminates in an outer edge 55. The outer end of the mounting bar 30 terminates in a hook 80 which is a U-shaped element formed and sized to clamp over the edge 55 of the apron 54(*a*) to firmly anchor the umbrella support against any possible lateral displacement. In this form of the invention, there is illustrated the use of two stabilizing members 31(*a*) connected to the pool-side portion of the mounting bar 30 and engaging the deck 56, so that the mounting bar 30 will not be rotated and tip the umbrella into the water 53. In all other respects the form of the invention of FIG. 2 is identical to that of FIG. 1 and like reference numerals have been employed to identify like parts.

Although minor modifications might be suggested by those versed in the art, it should be understood that I wish to embody within the scope of the patent warranted hereon all such modifications as reasonably and properly come within the scope of my contribution to the art.

I claim as my invention:

1. In combination with an in-ground swimming pool having side walls extending below grade level and a bottom wall and surrounded by an apron forming a deck at grade level, a cantilevered above-water pool umbrella assembly for protecting pool occupants while in the water, said assembly comprising:

an umbrella adapted to be selectively extended and retracted in a horizontal direction above grade and water level and extended to be disposed in a generally superjacent space parallel relationship above the level and surface of the water in the pool;

a vertical umbrella support pole projecting vertically upwardly above grade and water level to form an upright vertical support column carrying said umbrella;

a mounting bar on said deck and extending at deck level out over and above the surface of the water in the pool;

a connecting joint between one end of said mounting bar and the lower end of said umbrella pole to vertically support the pole and the umbrella in an upright position;

and anchoring means at the other end of said mounting bar to anchor the umbrella to the apron of the pool, said anchoring means more particularly comprising:

a stabilizing means engaging the horizontally disposed surface of the deck and resisting vertical displacement forces, thereby to provide vertical support for the cantilevered umbrella on the vertical support column, and lateral displacement prevention means to firmly lock the umbrella support assembly against involuntary lateral displacement toward or away from the pool.

2. The invention of claim 1, wherein said anchoring means further comprises:

a stand locked to the end of said mounting bar;

said stand comprising a box-shaped container having a hollow compartment with a filling nozzle and adapted to receive a ballast of water, said lateral displacement prevention means comprising means on said box-shaped container arid on said mounting bar for engaging the pool deck at laterally spaced apart locations, thereby to prevent involuntary lateral displacement.

3. The invention of claim 2, further characterized by said lateral displacement prevention means having wheel means for rotatably engaging the support surface, whereby lateral portable transport adjustability of the umbrella over the surface of the pool is afforded.

4. The invention of claim 1, wherein said lateral displacement prevention means of said anchoring means comprises a hook on the other end of said mounting bar for engaging and locking against the edge of the pool apron.

5. The invention of claim 1, wherein said stabilizing means connected to said mounting bar include means engageable with the deck of the pool apron to prevent inadvertent rotation thereof.

6. A cantilevered canopy comprising, in combination, an umbrella;

an umbrella pole carrying said umbrella and disposed on a vertical axis;

an elongated substantially horizontal mounting bar having one end thereof connected to the lower end of said umbrella pole and having its opposite second end extending away from said axis to a location remote from said vertical axis of the umbrella pole; and an anchoring means connected to said mounting bar at its second end to anchor the umbrella to a support surface, said umbrella comprising a cover fabric mounted on a framework of thin ribs and being expandable from a folded position to a closed position, said umbrella pole comprising a hollow metal pole connected to said framework and having a slidable ring connected to some of said ribs to accommodate the opening and closing of the umbrella cover, the lowermost end of said umbrella pole being connected to said mounting bar by means of a swivel joint so that said umbrella bar and closed umbrella may be folded in close adjacency to the mounting bar for storage purposes, said anchoring means more particularly comprising:

a stabilizing means engaging a horizontally disposed support surface and resisting vertical displacement forces, thereby to provide vertical support for the cantilevered umbrella on the vertical support column provided by the umbrella pole, and lateral displacement prevention means to firmly lock the umbrella support assembly against involuntary lateral displacement toward or away from the point of utilization.

7. An umbrella assembly foldable into a portable kit and comprising:

an umbrella pole for prescribing a vertical support reference axis;

a mounting bar for prescribing a horizontal support reference axis;

a swivel coupling joint interconnecting one end of said pole and one end of said mounting bar;

a selectively retractable umbrella connected to the opposite end of said pole;

said pole and said umbrella, when retracted, being folded back upon one another, and a wheel-mounted anchoring means connected to the opposite end of said mounting bar, whereby the umbrella assembly may be selectively positioned with the anchoring means on the deck of a swimming pool and a mounting bar extended superjacent the water in the pool with the umbrella opened for protecting pool occupants while in the water.

* * * * *